US006591215B1

(12) United States Patent
Blumenthal et al.

(10) Patent No.: US 6,591,215 B1
(45) Date of Patent: Jul. 8, 2003

(54) SYSTEMS AND METHODS FOR CONTROLLING THE ACTIVITY OF CARBON IN HEAT TREATING ATMOSPHERES

(75) Inventors: Robert N Blumenthal, Brookfield, WI (US); Andreas T Melville, Brookfield, WI (US)

(73) Assignee: Furnace Control Corp., Milwaukee, WI (US)

( * ) Notice: Subject to any disclaimer, the term of this patent is extended or adjusted under 35 U.S.C. 154(b) by 0 days.

(21) Appl. No.: 09/252,158

(22) Filed: Feb. 18, 1999

(51) Int. Cl.[7] ..... C21D 11/00

(52) U.S. Cl. ..... 702/130; 702/136; 266/80

(58) Field of Search ..... 702/130, 22–24, 702/27, 28, 30–32, 33, 45, 47, 50, 98–100, 108, 114, 127, 134–136, 138, 140, 182–184, 188, FOR 115–FOR 119, FOR 123–FOR 124, FOR 127, FOR 128, FOR 134, FOR 135, FOR 141–FOR 143, FOR 155, FOR 170, FOR 171, 210; 148/208, 215, 216, 218, 629, 633, 278, 287, 231, 511, 508, 206, 207, 634; 266/251–253, 256, 257, 78, 80, 96, 99, 100, 87–89, 900, 81; 204/424, 427, 433, 428; 205/784.5, 785; 436/134, 195; 422/83; 73/23.2, 23.25–23.27, 529; 374/139; 419/2

(56) References Cited

U.S. PATENT DOCUMENTS

| | | | | | |
|---|---|---|---|---|---|
| 3,844,770 | A | | 10/1974 | Nixon | 75/529 |
| 4,158,166 | A | | 6/1979 | Isenberg | 324/439 |
| 4,285,742 | A | | 8/1981 | Bowes et al. | 148/278 |
| 4,288,062 | A | * | 9/1981 | Gupta et al. | 266/88 |
| 4,485,002 | A | | 11/1984 | Wunning | 204/424 |
| 4,588,493 | A | * | 5/1986 | Blumenthal et al. | 204/428 |
| 4,992,113 | A | | 2/1991 | Baldo et al. | 148/208 |
| 5,137,616 | A | | 8/1992 | Poor et al. | 204/428 |
| 5,211,820 | A | | 5/1993 | Poor et al. | 205/784.5 |
| 5,231,645 | A | * | 7/1993 | Uno et al. | 148/215 |
| 5,352,344 | A | | 10/1994 | Gohring et al. | 205/784 |
| 5,385,337 | A | | 1/1995 | Schultz | 266/81 |
| 5,393,403 | A | | 2/1995 | Sasabe et al. | 204/422 |
| 5,496,450 | A | * | 3/1996 | Blumenthal et al. | 204/427 |
| 5,498,299 | A | | 3/1996 | Schmidt | 148/210 |
| 5,556,556 | A | | 9/1996 | Blumenthal et al. | 205/784.5 |
| 5,666,631 | A | | 9/1997 | Polizzotti et al. | 419/2 |
| 5,772,428 | A | * | 6/1998 | Van Den Sype et al. | 148/634 |

OTHER PUBLICATIONS

Trade Brochure Furnace Control Corporation "Lamination Annealing Control Systems" Undated, 2 pages.

Chen, Yong Chwang, *Automatic Control of the Carbon Potential of Furnance Atmospheres without Adding Enriched Gas*, Metallurgical Transactions, vol. 24B Oct. 1993, pp. 881–888.

Sastri and Abraham, Atmosphere Control in Heat Treatment Furnaces Using Oxygen Probes, Tool & Alloy Steels, Apr. & May 1986 pp. 155–162.

(List continued on next page.)

*Primary Examiner*—Hal Wachsman
(74) *Attorney, Agent, or Firm*—Ryan Kromholz & Manion, S.C.

(57) ABSTRACT

Systems and methods monitor the activity of carbon in a heat treating atmosphere, e.g., where a two phase region is desired for spherodize annealing. The systems and methods generate a computed activity of carbon value for the gas atmosphere as a function of temperature, partial pressure of oxygen, and carbon monoxide content of the gas atmosphere, and without determining a carbon dioxide content of the gas atmosphere. The systems and methods can make use of the computed activity of carbon value, e.g., to control the gas atmosphere.

34 Claims, 8 Drawing Sheets

OTHER PUBLICATIONS

Armson et al., Electrochemical Sensors for Heat Treatment Atmosphere Monitoring, CKN Group Technological Centre, Wolverhampton England pp. 905–918. (No date).

Controlled Atmos, annealing of steel using oxygen sensors to control and monitor atmosphere compan. Japanese Patent Abstract, JP 7988711 Dialog Search, Jul. 1979.

Annealing steel strip in furnace in which one oxygen sensor is used for controlling gas compsn. in combination with gas dew–point meter, Japanese patent Abstract, Dialog Search, JP56102518, Aug. 1981.

Oxygen sensor for annealing, Japanese Patent Abstact JP 60–9447., Jan. 1980.

Robert, Marc; Carbon flux method controls N2–hydrocarbon decarblrecarb; Heat Treating/Sep. 1990 pp. 22–24.

Stanescu, Mircea Stefan Ph.D.; Principal annealing atmospheres for steel rod and wire; pp. 79–83. (No date).

Powers, Charles et al.; "Process Control for Short Time Cycle Spheroidize Annealing", 17 pages. (No date).

Apparatus for oxygen analysis, Japanese patent Abstract, JP 91–330656, Dec. 1991.

Blumenthal, Control of Endothermic Generators–A Technical Comparison of Endothermic and Nitorgen.Methanol Carrier Atmosphere; ASM International; pp. 19–25 1996 (No month).

Robert, Marc J.; Baldo, Pascal P.; Automatic prevention of decarburization through ALNAT FC processing; pp. 75–78. (No date).

Heat Treating Progress News "Ispen unveils new sensor technology", Advanced Materials & Processes 10/98 pp. 128–129, 2 pages.

Ipsen International Inc. Advanced Materials & Processes 10/98 pp. 122–123.

ASM Handbook vol. 4 Heating Treating Circa 1998. (No month).

* cited by examiner

SYSTEMS AND METHODS FOR CONTROLLING THE ACTIVITY OF CARBON IN HEAT TREATING ATMOSPHERES

FIELD OF THE INVENTION

This invention relates generally to the monitoring and/or control of atmospheres within heat treating furnaces.

BACKGROUND OF THE INVENTION

Steel parts can undergo a process called carburizing or neutral hardening inside a heat treating furnace. Inside the furnace, the steel parts are exposed to prescribed high temperature conditions in the presence of a specially formulated, carbon-enriched gas atmosphere.

Most heat treating atmospheres contain carbon monoxide (CO), carbon dioxide ($CO_2$), methane ($CH_4$), hydrogen ($H_2$), and water vapor ($H_2O$). The relative amounts of these gases in the atmosphere depend upon the type of carrier gas used, the processing temperatures, and the amount of enriching gas added during processing.

For example, an endothermically generated gas, produced by catalytic cracking of natural gas in the presence of air, typically contains the following nominal ranges (expressed in % by volume)of gas constituents:

| | |
|---|---|
| CO ≈ 20% | $CO_2$ ≈ 0.1% to 0.5% |
| $H_2$ ≈ 40% | $H_2O$ ≈ 0.2% to 1.2% |
| $N_2$ ≈ 40% | $CH_4$ ≈ 0.2% to 0.8% |

In gas carburization, a common commercial practice is to use an endothermic gas carrier enriched with natural gas or propane. The process variables used to monitor and control the carburization process using this type of atmosphere include (i) the carbon potential of the heat treating atmosphere (expressed as a weight percent of carbon), (ii) the temperature of the heat treating furnace, and (iii) the processing time.

For a given temperature condition, the reactions that transfer carbon to the surface of the steel part are maintained by keeping the carbon potential of the gas atmosphere within a defined range. For example, if the carbon potential of the furnace atmosphere is greater than the carbon potential of the surface of the steel parts being processed, carburization occurs, i.e., carbon is transferred from the gas atmosphere to the surface of the steel parts. Increasing the carbon potential of the gas atmosphere increases the rate of carburization. However, if the carbon potential of the atmosphere at a given temperature exceeds a critical value beyond the defined range, sooting occurs. Likewise, if the carbon potential of the atmosphere at a given temperature is less than the carbon potential of the surface of the steel parts being processed, decarburization occurs, i.e., carbon is transferred from the surface of the steel parts to the gas atmosphere.

The desired condition for neutral hardening is one in which the carbon potential of the atmosphere is equal to the carbon potential of the surface of the steel parts being processed. In this case, no carbon is transferred between the surface of the steel parts and the furnace atmosphere.

Further details regarding the concept of the carbon potential and the kinetic conditions for transfer of carbon between the surface of the steel part and the furnace atmosphere are found in Blumenthal, "Control of Endothermic Generators—A Technical Comparison of Endothermic and Nitrogen/Methanol Carrier Atmosphere," *Heat Treating Proceedings* (16$^{th}$ *ASM Heat Treating Society Conference & Exposition*), Mar. 19–21, 1998, pp. 19 to 25.

The carbon potential of an atmosphere with a fixed carbon monoxide concentration can be ascertained by measuring the partial pressure of carbon dioxide ($P_{CO2}$) in the atmosphere, using infrared analysis. This, however, requires sampling the gas from the furnace atmosphere and cooling it to room temperature. Sampling errors arise, due to possible leaks in the gas sampling line, alteration of the gas chemistry due to sooting, or the water-gas shift due to cooling, or a combination of these events. These sampling errors inherent in remote gas sampling are difficult to eliminate.

For this reason, a more common method for assessing the carbon potential has entailed the use of an in situ oxygen sensor used in association with a thermocouple.

The oxygen sensor is typically installed in the heat treating furnace in direct contact with the heated gas carburizing atmosphere. This obviates the sampling errors, described above, which are inherent in remote gas sampling techniques. The sensor includes a solid electrolyte. One side of the electrolyte contacts the carburizing atmosphere to be measured. The other side of the electrolyte contacts a reference gas, whose oxygen content is known.

A voltage (measured in millivolts) E(mv) is generated between the two sides of the electrolyte. The magnitude of this voltage E (mv) is a function of the temperature (sensed by the thermocouple) and the difference between the oxygen content in the carburizing atmosphere and the oxygen content in the reference gas. The voltage E(mv) can be expressed as follows:

$$E(\text{mv}) = 0.0496T \times \log\frac{P_{O2}(Ref)}{P_{O2}} \tag{1}$$

where:

T is the sensed temperature (in degrees Kelvin ° K).

$P_{O2}$ (Ref) is the known partial pressure of oxygen in the reference gas, which in the illustrated embodiment is air at 0.209 atm. Other reference gases can be used.

$P_{O2}$ is the partial pressure of oxygen in the heat treating atmosphere.

Knowing the oxygen content of the reference gas [$P_{O2}$ (Ref)], one can determine the oxygen content of the furnace atmosphere [$P_{O2}$] by measuring the probe voltage [E(mv)] and the temperature T(° K). Knowing the carbon monoxide content of the carrier gas (which can be pre-set or separately measured by infrared analysis), the isothermal relationship between the oxygen probe voltage output and carbon potential can be experimentally ascertained and plotted for different temperature conditions. In this way, the carbon potential can be directly related to the oxygen probe voltage and temperature.

Further details of this relationship between oxygen probe voltage and carbon potential are found in the above-identified article by Blumenthal.

In use, a controller associated with the heat treating furnace compares the carbon potential of the furnace atmosphere to a "set point" carbon potential, which is selected to reflect a targeted carbon potential. The controller controls the addition of an enriching gas, such as natural gas, into the atmosphere to maintain the carbon potential of the atmosphere at the set point, and thereby maintain the desired carbon potential in the atmosphere.

The control of carbon potential is only meaningful when the steel being processed is in a single phase field, i.e., austenite. This single phase field occurs only at elevated temperatures and is dependent on the alloy content, the carbon content of the steel, and the temperature.

There are other, lower temperature heat treating applications, e.g., spherodize annealing. In spherodize annealing, the objective is to create a two phase region, where the microstructure of the steel being processed comprises spherical-shaped particles of iron carbide(cementite) ($Fe_3C$) distributed in a matrix of alpha iron (ferrite) ($\alpha$-Fe). This ferrite and iron carbide microstructure produces a steel that is very ductile and easily deformable by plastic deformation. The steel fastener industry, for example, depends upon steel that is in the spherodize annealed condition.

FIG. 1 shows a typical iron-carbon binary phase diagram for hypoeutectoid and hypereutectoid plain carbon steel compositions possessing different weight percentages of carbon. The diagram shows that there is a critical temperature $A_1$ (about 1333° F.) at which the desired two phase ferrite and iron carbide microstructure exists for both hypoeutectoid and hypereutectoid compositions. The most commercially practical spherodize annealing rates exist at or near the temperature $A_1$. This preferred region is shaded in FIG. 1.

Below $A_1$, the rate of spherodize annealing decreases with decreasing temperature for both hypereutectoid and hypoeutectoid compositions. At or below a temperature of about 1250° F., the decreased rate becomes commercially impractical.

For hypoeutectoid compositions (i.e., with weight percent carbon below about 0.8), Above the temperature $A_1$, equilibrium phases of austenite ($\gamma$-Fe) and ferrite occur, until the temperature exceeds $A_3$. Above the temperature $A_3$, single phase austenite forms, and spherodize annealing conditions cease. As FIG. 1 shows, the temperature corresponding to $A_3$ varies according to the weight percent carbon of the hypoeutectoid composition.

For hypereutectoid compositions (i.e., having weight percent carbon above about 0.8), equilibrium phases of austenite and iron carbide form above the temperature $A_1$, until the temperature reaches $A_{CM}$. Above $A_{CM}$, single phase austenite forms. As FIG. 1 shows, the temperature corresponding to $A_{CM}$ varies according to the weight percent carbon of the hypereutectoid composition.

During spherodize annealing, the objective is to provide a gas atmosphere that does not carburize or decarburize or oxidize the steel parts. The purpose of spherodize annealing is to produce the particular two-phase microstructure just described.

In the spherodize annealing process, the relative amounts of the two phases, e.g., ferrite and iron carbide, must remain unchanged. Thus, the heat treating atmosphere must be close to equilibrium with the two-phase ferrite and iron carbide. The atmosphere must be properly maintained to prevent either carburization (i.e., the conversion of ferrite with carbon from the atmosphere to produce iron carbide) or decarburization (i.e., the conversion of iron carbide to ferrite resulting from the removal of carbon by the atmosphere). The atmosphere must also prevent oxidation of the steel parts.

Carbon potential is meaningful only in a single phase region. Thus, the carbon potential is not an appropriate process variable for controlling the two-phase spherodize annealing process.

The activity of carbon (or $A_C$) can be used as a process variable to control the furnace atmosphere to achieve the objectives of spherodize annealing. When the $A_C$ of a furnace atmosphere is equal to the $A_C$ of the two phase mixture of ferrite and iron carbide, the atmosphere is in equilibrium with the steel parts. In the equilibrium condition, there is no transfer of carbon between the steel and the furnace atmosphere.

$A_C$ is a function of the partial pressure of carbon monoxide ($P_{CO}$) and the partial pressure of carbon dioxide ($P_{CO}$) at a given temperature condition. $A_C$ can be expressed as follows:

$$A_C = K_1(P_{CO}/P_{CO2})P_{CO} \tag{2}$$

where $K_1$ is the thermodynamic constant of the reaction $2CO = \underline{C} + CO_2$, which occurs during an exchange of carbon between the furnace atmosphere and the steel parts, where:

CO is carbon monoxide, $CO_2$ is carbon dioxide, and $\underline{C}$ represents carbon in solution in iron.

$A_C$ may also be represented by the following equation:

$$A_C = \frac{K_1}{100} \times \frac{(\%\ CO)^2}{\%\ CO_2} \tag{3}$$

where %CO is the percent carbon monoxide in the furnace atmosphere, and $\%CO_2$ is the percent of carbon dioxide in the furnace atmosphere.

There are atmospheres used for spherodize annealing of steel rod and wire, where relatively high concentrations of carbon monoxide are present, e.g., mixtures of exothermic and endothermic gases; mixtures of nitrogen and endothermic gases; and mixtures of nitrogen and methanol. These atmospheres are described in Stanescu, "Principal Annealing Atmospheres for Steel Rod and Wire," *Wire Journal® International,* pp. 79–83, June 1991.

In these carbon monoxide-rich atmospheres, the %CO and $\%CO_2$ values in the atmosphere can be measured by removing atmosphere from the furnace for infrared analysis at room temperature. As already discussed, this technique is prone to many sampling errors. Nevertheless, in these carbon monoxide-rich atmospheres, the absolute value of the sampled ratio $[(\%CO)^2/\%CO_2]$ can be at least quantified in some manner, albeit inexactly. The sampled ratio is proportional to $A_C$, by virtue of the thermodynamic constant $K_1$. The relationship between the sampled ratio and $A_C$ can be experimentally determined for a given set of operating conditions.

In use, a controller compares the measured ratio to a set point value. Based upon the comparison, the controller can govern the mixing of appropriate gases to keep the ratio at the designated set point value.

Nevertheless, the use of a sampled ratio $[(\%CO)^2/\%CO_2]$ as an indication of $A_C$ is, at best, not exact and subject to a whole host of sampling errors. It also requires the presence of an atmosphere with a high concentration of carbon monoxide (i.e., "richer"), to enable the infrared analysis to be conducted in the first instance. These carbon monoxide-rich atmospheres are expensive to generate, highly kinetically reactive, and require the high degree of monitoring and control.

Atmospheres lower in carbon monoxide concentration (i.e., "leaner") are well suited for use in applications where two phase regions exist, such as spherodize annealing. For example, as described in the above identified Stanescu article, carbon monoxide-lean atmospheres can be produced for spherodizing steel rod and wire by mixing nitrogen with a hydrocarbon (e.g., propane or propylene). The leaner atmospheres tend to be cheaper to generate, less kinetically reactive, and do not require the tight control that carbon monoxide-rich atmospheres require. However, due to the relatively low concentrations of carbon dioxide present in leaner atmospheres, the measurement of $\%CO_2$ by infrared analysis becomes, at best, problematic.

For example, at 1333° F., $K_1$=0.457, and if %CO=1% and $A_C$=1, then, according to Equation (3), $\%CO_2$0.0046%. The highest accuracy of a conventional $CO_2$ analyzer is ±0.002%. It can thus be seen that, in these carbon monoxide-lean atmospheres, the accurate assessment of the activity of carbon from infrared measurements of %CO and $\%CO_2$ is not possible. Therefore, when a nitrogen-hydrocarbon atmosphere is used and the percent carbon monoxide is less than one percent, there exists no commercially viable way to accurately assess the activity of carbon during a spherodize annealing process.

In summary, to acquire even an error-prone sample ratio $[(\%CO)^2/\%CO_2]$ requires the presence of an expensive, highly reactive, carbon monoxide-rich atmosphere (e.g., a nitrogen/endothermic atmosphere). In cheaper, less reactive, carbon monoxide-lean atmospheres (e.g., a nitrogen-hydrocarbon atmosphere), it is possible to acquire only a rough estimation of the activity of carbon for control purposes.

SUMMARY OF THE INVENTION

One aspect of the invention provides systems and methods for monitoring the activity of carbon in a heat treating atmosphere, e.g., where a two phase region is desired for spherodize annealing. The systems and methods generate a computed activity of carbon value for the gas atmosphere from at least one sensor placed in situ in the gas atmosphere.

Another aspect of the invention provides systems and methods for generating as a function of temperature, partial pressure of oxygen, and carbon monoxide content of the gas atmosphere, and without determining a carbon dioxide content of the gas atmosphere.

The systems and methods can make use of the computed activity of carbon value, e.g., to control the gas atmosphere.

In a preferred embodiment, the systems and methods compare the computed activity of carbon output to a set point activity of carbon value and generate a control signal based upon the comparison. In a preferred embodiment, the selected activity of carbon value is approximately one.

The invention makes possible the realization of accurate and reliable assessment of the activity of carbon in any two phase region, regardless of the carbon monoxide concentration of the atmosphere and without requiring a remote and error-prone analysis of the percent carbon dioxide.

Other features and advantages of the inventions are set forth in the following Description and Drawings, as well as in the appended Claims.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DESCRIPTION OF THE PREFERRED EMBODIMENTS

Figure 2:
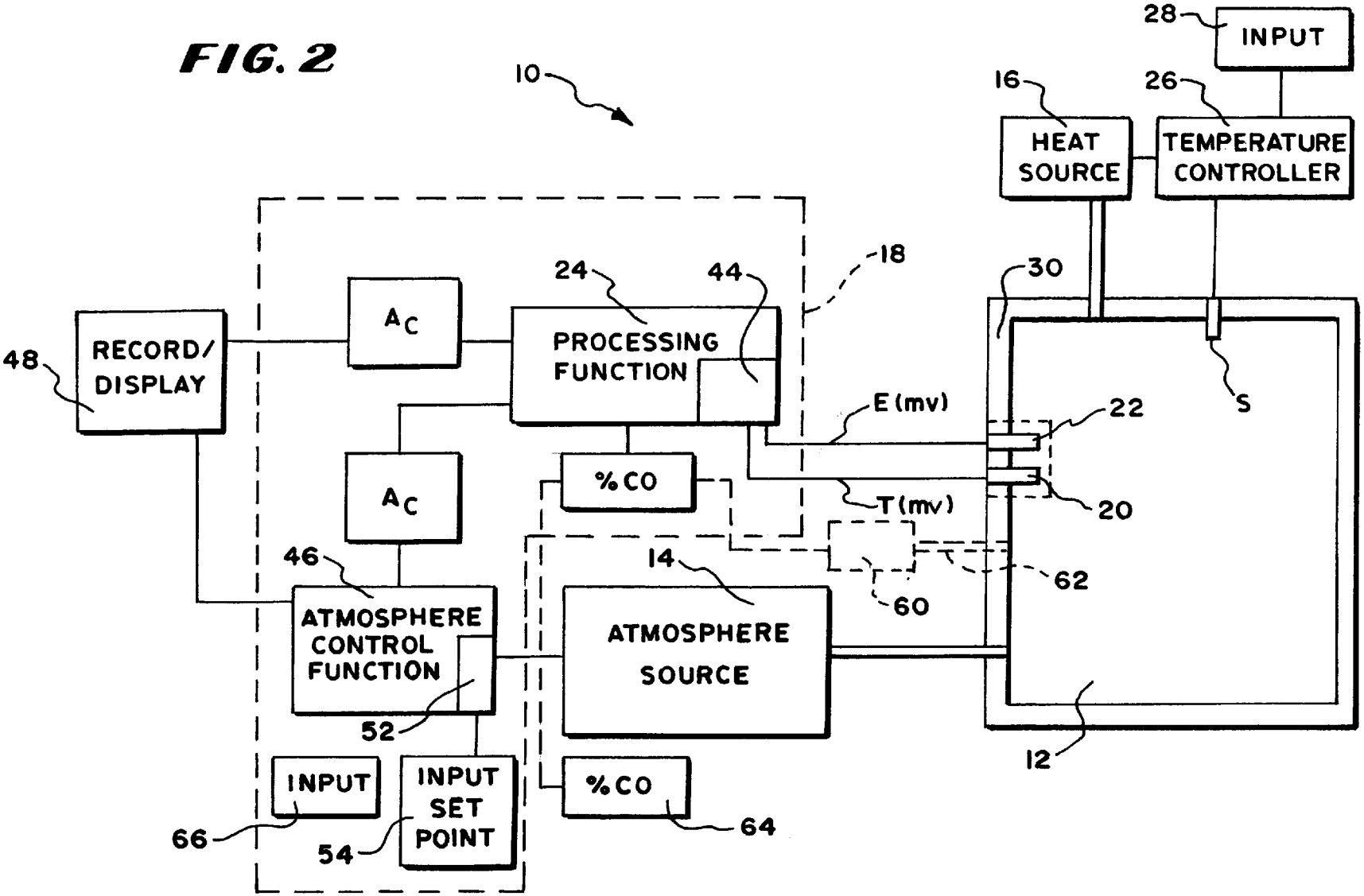
FIG. 2 is a schematic view of a system for heat treating metal, which includes a processing module for deriving an activity of carbon value as a function of in situ temperature and a voltage signal from an in situ oxygen sensor.

FIG. 2 shows a system 10 for controlling the atmosphere of a heat treating furnace 12 of the type used for spherodize annealing. FIG. 2 schematically shows the furnace 12 for the purpose of illustration, as the details of its construction are not material to the invention. The furnace 12 can comprise, e.g., a conventional batch, Short Time Cycle (STC) furnace of the type discussed in Powers et al., "Process Control for Short Time Cycle Spherodize Annealing," *Salem Furnace Company.*

The furnace 12 includes a source 14 of the desired heat treating atmosphere, which is conveyed into the furnace 12. The furnace 12 also includes a source 16 of heat for the furnace 12. The source 16 heats the interior of the furnace 12, and thus the heat treating atmosphere itself. The heated atmosphere reacts with steel parts within the furnace 12 to produce a spherodize microstructure, as previously described.

A temperature sensor S, e.g., a thermocouple, is electrically coupled to a furnace temperature controller 26, which is itself coupled to the heat source 16. The furnace temperature controller 26 compares the temperature sensed by the sensor S to a desired value set by the operator (using, e.g., an input device 28). The furnace temperature controller 26 generates command signals based upon the comparison to adjust the amount of heat provided by the source 16 to the furnace 12, to thereby maintain the desired temperature.

The system 10 includes a processor 18 for monitoring or controlling the activity of carbon $A_C$ of the atmosphere at the temperature maintained in the furnace 12, to thereby prevent or minimize carburization, decarburization, sooting, or oxidation on the surface of the parts.

According to one aspect of the invention, the processor 18 need not include any remote gas analyzer. Instead, the processor 18 can include only an in situ temperature sensor 20 and an in situ oxygen sensor 22. The processor 18 also includes a microprocessor controlled processing function 24, which is electrically coupled to the temperature and oxygen sensors 20 and 22.

The oxygen sensor 22 can be variously constructed. In FIG. 2, the oxygen sensor 22 is of the type described in U.S. Pat. No. 4,588,493 ("the '493 patent"), entitled "Hot Gas Measuring Probe." The '493 patent is incorporated into this Specification by reference.

The oxygen sensor 22 is installed through the wall 30 in the furnace 12. The oxygen sensor 22 is thereby exposed to the same temperature and the same atmosphere as the metal parts undergoing processing.

Figure 3:
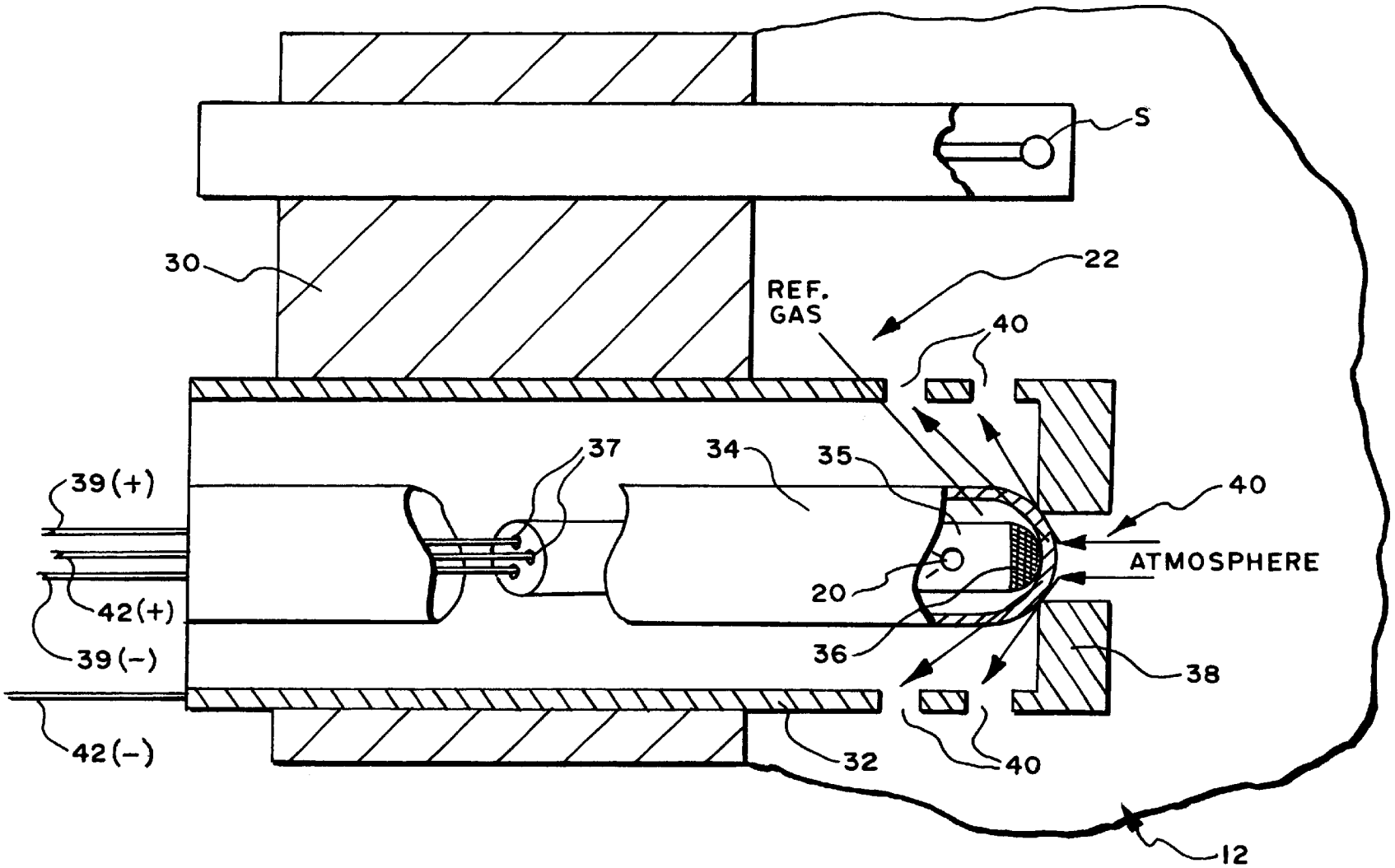
FIG. 3 is a side view, with portions broken away and in section, exemplifying one of the types of in situ temperature and oxygen sensors, which can be coupled to the processing module shown in FIG. 2.

As FIG. 3 shows, the oxygen sensor 22 includes an outer sheath 32, which, in the illustrated embodiment, is made of an electrically conductive material. Alternatively, the sheath 32 could be made of an electrically non-conductive material.

The sheath 32 encloses within it an electrode assembly. The electrode assembly comprises a solid, zirconia electrolyte 34, formed as a hollow tube, and two electrodes 36 and 38.

The first (or inner) electrode 36 is placed in contact with the inside of the electrolyte tube 34. A reference gas occupies the region where the inside of the electrolyte 34 contacts the first electrode 36. The oxygen content of the reference gas is known.

The second (or outer) electrode 38, which also serves as an end plate of the sheath 32, is placed in contact with the outside of the electrolyte tube 34. The furnace atmosphere circulates in the region where the outside of the electrolyte 34 contacts the second electrode 38. The furnace atmosphere circulates past the point of contact through adjacent apertures 40.

A voltage E (mv) is generated between the two sides of the electrolyte 34. As previously explained, and as expressed in Equation (1), the magnitude of E (mv) is related to the temperature and the difference between the oxygen content in the furnace atmosphere and the oxygen content in the reference gas.

The voltage-conducting lead wires 42 (+) and 42 (−)are coupled to the processing function 24. Alternatively, when an electrically non-conductive sheath 32 is used, internal lead wires (not shown) are coupled to the second electrode 38 to conduct the voltage E (mv) to the processing module 24.

Other types and constructions for the oxygen sensor 22 can be used. For example, the oxygen sensor 22 can be of the type shown in U.S. Pat. No. 4,101,404. Commercial oxygen sensors can be used, e.g., the CARBONSEER™ or ULTRA PROBE™ sensors sold by Marathon Monitors, Inc., or ACCUCARB® sensors sold by Furnace Control Corporation. Some oxygen sensors are better suited for use in higher temperature processing conditions, while other oxygen sensors are better suited for lower temperature processing conditions.

In the illustrated embodiment, the temperature sensor 20 takes the form of a thermocouple. Preferably, the temperature sensor 20 is carried within the electrolyte tube 34, e.g., by a ceramic rod 35. In this arrangement, the ceramic rod 35 includes open interior bores 37, through which the reference gas is introduced into the interior of the electrolyte tube 34. The lead wire 42 (+) for the oxygen sensor 22 passes through one of the bores 37, and the other lead wire 42 (−) for the oxygen sensor 22 is coupled to the sheath 32. The lead wires 39 (+) and 39 (−) for the thermocouple sensor 20 pass through the other bores 37, to conduct the thermocouple voltage output t (mv) to the processing function 24.

By virtue of this construction, the temperature sensor 20 is exposed to the same temperature conditions as the furnace atmosphere circulating past the point of contact of the electrolyte 34 and electrodes 36 and 38. This is also essentially the same temperature condition as the metal parts undergoing treatment.

Alternatively, the temperature sensor 20 can comprise a separate sensor, which is not an integrated part of the oxygen sensor 22. The thermocouple S, used in association with the heat source 16, can also be used to sense temperature conditions for use in association with the oxygen sensor 22.

The processing function 24 includes a resident algorithm 44. The algorithm 44 computes the activity of carbon $A_C$ as a function of temperature of the atmosphere, oxygen partial pressure of the atmosphere, and carbon monoxide partial pressure of the atmosphere.

The input indicative of the carbon monoxide partial pressure in the atmosphere in the furnace can be generated in various ways. The input can be provided, e.g., by a remote infrared sensor 60 (shown in FIG. 2), which communicates with the furnace 12 through a gas sampling tube 62 installed through the furnace wall 30. The infrared sensor 60 analyses the sampled gas atmosphere at room temperature to ascertain the %CO. The sensor 60 conveys a voltage input to the processing function 24.

Alternatively, however, the carbon monoxide content of the atmosphere gas can be ascertained in accordance with the invention without need for the remote sensor 60. For example, the carbon monoxide content of the atmosphere can be preset by the operator using, e.g., an input 64 to the atmosphere source 14. The preset input 64 is also conveyed to the processing function 44.

Still alternative, as will be described in greater detail later, in atmospheres formed from a mixture of nitrogen and an endothermic atmosphere, or a mixture of nitrogen and methanol, the partial pressure of carbon monoxide can be expressed as a function of E (mv) from the oxygen sensor 22 and t (mv) from the temperature sensor 20, without need of remote sensing of carbon monoxide.

The resident algorithm 44 is based upon the activity of carbon for the following reaction:

$$CO = \underline{C} + \frac{1}{2}O_2 \tag{4}$$

where:

CO is carbon monoxide.

$\underline{C}$ is the carbon in solution in iron.

$O_2$ is oxygen.

The activity of carbon $A_C$ for this reaction can be expressed as follows:

$$A_C = (K_2)P_{CO}/(P_{O2})^{1/2} \tag{5}$$

where:

$P_{CO}$ is the partial pressure of carbon monoxide in the gas atmosphere.

$P_{O2}$ is the partial pressure of oxygen in the gas atmosphere.

$K_2$ is the thermodynamic constant for the reaction of Equation (4).

$K_2$ can also be expressed exponentially, as follows:

$$K_2 = e^{-\left[\frac{27.000+20.95T}{1.9872T}\right]} \tag{6}$$

where:

T is the temperature sensed by the temperature sensor 20, in ° K.

The partial pressure of oxygen $P_{O2}$, in turn, is related to the voltage signal E(mv) of the oxygen sensor 22, as expressed in Equation (1), previously described.

By algebraic substitution of variables in Equations (1), (5), and (6), an expression for $A_C$ can be derived as a function of E (mv), the sensed or preset partial pressure of carbon monoxide $P_{CO}$, and mv-temperature signal t(mv), expressed as temperature T in ° K, as follows:

$$A_C = e^{-\left[\frac{27.000+20.95T}{1.9872T}\right]} P_{CO}(2.1874)10^{\frac{E(mv)}{0.0992T}} \tag{7}$$

The algorithm applies Equation (7) to derive the activity of carbon $A_C$. In this way, the processing function derives the activity of carbon $A_C$ without directly determining the absolute value of $P_{CO2}$. As the absolute $CO_2$ content of the atmosphere is not a constraining variable, the processing function 24 can derive the activity of carbon $A_C$ by applying Equation (7) in both rich carbon monoxide and lean carbon monoxide atmospheres. Application of the Equation (7) makes possible the accurate control of the activity of carbon $A_C$ in all atmospheres, including leaner, less reactive atmospheres, where greater variations in the carburizing environment can be tolerated without the sudden onset of sooting or decarburizing conditions.

The factor $P_{CO}$ in Equation (7) can be inputted to the processing function 24 in various ways. For example, as already described, remote infrared sensing can be used.

Alternatively, when an atmosphere formed from a mixture of nitrogen and an endothermic atmosphere is used, the flow rate of nitrogen and the endothermic atmosphere introduced into the furnace 12 can individually be set at a fixed rate. In this circumstance, the partial pressure of carbon monoxide can also be expressed as a function of E (mv) from the oxygen sensor 22 and t (mv) from the temperature sensor 20, without need of remote sensing. In this arrangement, the activity of carbon $A_C$ can be derived solely based upon the output of the oxygen sensor 22 and thermocouple 22, without requiring the use of a separate carbon monoxide sensing sensor or independently controlling the carbon monoxide content of the atmosphere.

More particularly, when the flow rates of nitrogen and the endothermic atmosphere or nitrogen and methanol atmosphere are fixed, the sum of the partial pressures of carbon monoxide and carbon dioxide will equal a constant quantity H, therefore:

$$P_{CO}+P_{CO_2}=H \tag{8}$$

The partial pressure of carbon monoxide $P_{CO}$ can therefore be expressed, as follows:

$$P_{CO}=H-P_{CO_2} \tag{9}$$

Given the thermodynamic reaction:

$$CO + \frac{1}{2}O_2 = CO_2 \tag{10}$$

the thermodynamic equilibrium constant $K_3$ can be expressed as:

$$K_3 = \frac{P_{CO2}}{P_{CO}(P_{O2})^{1/2}} \tag{11}$$

$K_3$ can also be expressed exponentially, as follows:

$$K_3=e^{-\Delta G_{10}^{\circ}/RT} \tag{12}$$

where:

the quantity:

$$\Delta G_{10}^{\circ}$$

is the standard free energy for Equation (10), expressed in calories per mole as follows:

$$\Delta G_{10}^{\circ}=-67{,}495+20.758T \tag{13}$$

R is the gas constant (i.e., 1.9872 cal/mole$^{-\circ K}$), and

T is the temperature in ° K.

From the Expression (11), the ratio of the partial pressures of carbon dioxide and carbon monoxide can be derived as a function of the thermodynamic constant $K_3$ and the partial pressure of oxygen, as follows:

$$K_3(P_{O2})^{1/2} = \frac{P_{CO2}}{P_{CO}} \tag{14}$$

Combining Equations (9) and (14), the following expression for $P_{CO}$ is derived:

$$P_{CO} = \frac{H}{1 + K_3 P_{O2}^{1/2}} \tag{15}$$

The partial pressure of oxygen $P_{O2}$ in Equation (15) can, in turn, be related to the E (mv) output of the oxygen sensor 22 and the t (mv) output of the thermocouple 20, expressed as temperature T in ° K, as follows:

$$(P_{O2})^{1/2}=0.4572(10^{-E(mv)/0.0992T}) \tag{16}$$

By algebraic substitution of variables in expressions (12), (13), (15), and (16), the partial pressure of carbon monoxide $P_{CO}$ can also be expressed as a function of the E (mv) output of the oxygen sensor 22 and the t (mv) output of the thermocouple 20, expressed as temperature T in ° K, as follows:

$$P_{CO} = H\left[\frac{1}{1 + \left(e^{-\Delta G_{10}^{O}/RT}\right)(0.4572)(10^{-E(mv)/0.0992T})}\right] \tag{17}$$

or, alternatively:

$$P_{CO} = H\left[\frac{1}{1 + e^{\left[\frac{67.495-20.7587}{1.9872T}\right]}(0.4572)\left(10^{\frac{-E(mv)}{0.0992T}}\right)}\right] \tag{18}$$

To supply the input variables E (mv) and t (mv) to the algorithm 44, the processing function 24 is electrically coupled to the lead wires 42 (+) and 42 (−) of the oxygen sensor 22 and the lead wires 39 (+) and 39 (−) of the temperature sensor 20. An input reflecting the partial pressure of CO is also supplied in the manners previously described, or as derived directly from electrical inputs E (mv) and t (mv), expressed as temperature T in ° K. The electrical inputs are supplied to the algorithm 44, which provides, as an output, the quantity $A_C$ according to Equation (7). The output expresses the magnitude of the activity of carbon $A_C$.

Unlike prior systems, the system 10 requires no measurement of the carbon dioxide content by remote sensing at ambient temperatures to derive the activity of carbon $A_C$.

The processing function 24 outputs the calculated activity of carbon $A_C$ for further uses by the system 10. The activity of carbon $A_C$ output can, e.g., be displayed, or recorded over time, or used for control purposes, or any combination of these processing uses.

For example, in FIG. 2, the system 10 includes a display device 48 coupled to the processing function 24. The display device 48 presents the calculated activity of carbon $A_C$ for viewing by the operator. The display device 48 can, of course, show other desired atmosphere or processing information. Alternatively, or in combination, a printer or recorder can be coupled to the processing function 24 for showing the calculated activity of carbon $A_C$ and its fluctuation over time in a printed strip chart format.

In a preferred embodiment, the processor 18 further includes an atmosphere control function 46. The atmosphere control function 46 includes a comparator function 52. The comparator function 52 compares the calculated activity of carbon $A_C$ to a desired control value or set point, which the operator can supply using, e.g., an input 54. Based upon the deviation between the calculated activity of carbon $A_C$ and the set point, the atmosphere control function 46 generates a control signal to the atmosphere source 14. The control function 46 generates signals, to adjust the atmosphere to establish and maintain the calculated activity of carbon $A_C$ at or near the set point. The control function 46 is also coupled to the device 48 to show other atmosphere or processing information. In this way, the processor 18 works to maintain atmosphere conditions optimal for the desired processing conditions.

As described above, the atmosphere used in the spherodize annealing process should prevent carburization, decarburization, and oxidation of the steel parts. In addition, the atmosphere should prevent sooting from occurring. The conditions for sooting occur when $A_C>1$. Since sooting is a kinetically controlled process, the rate of sooting will increase with increasing values of $A_C$ that are greater than unity.

Figure 1:
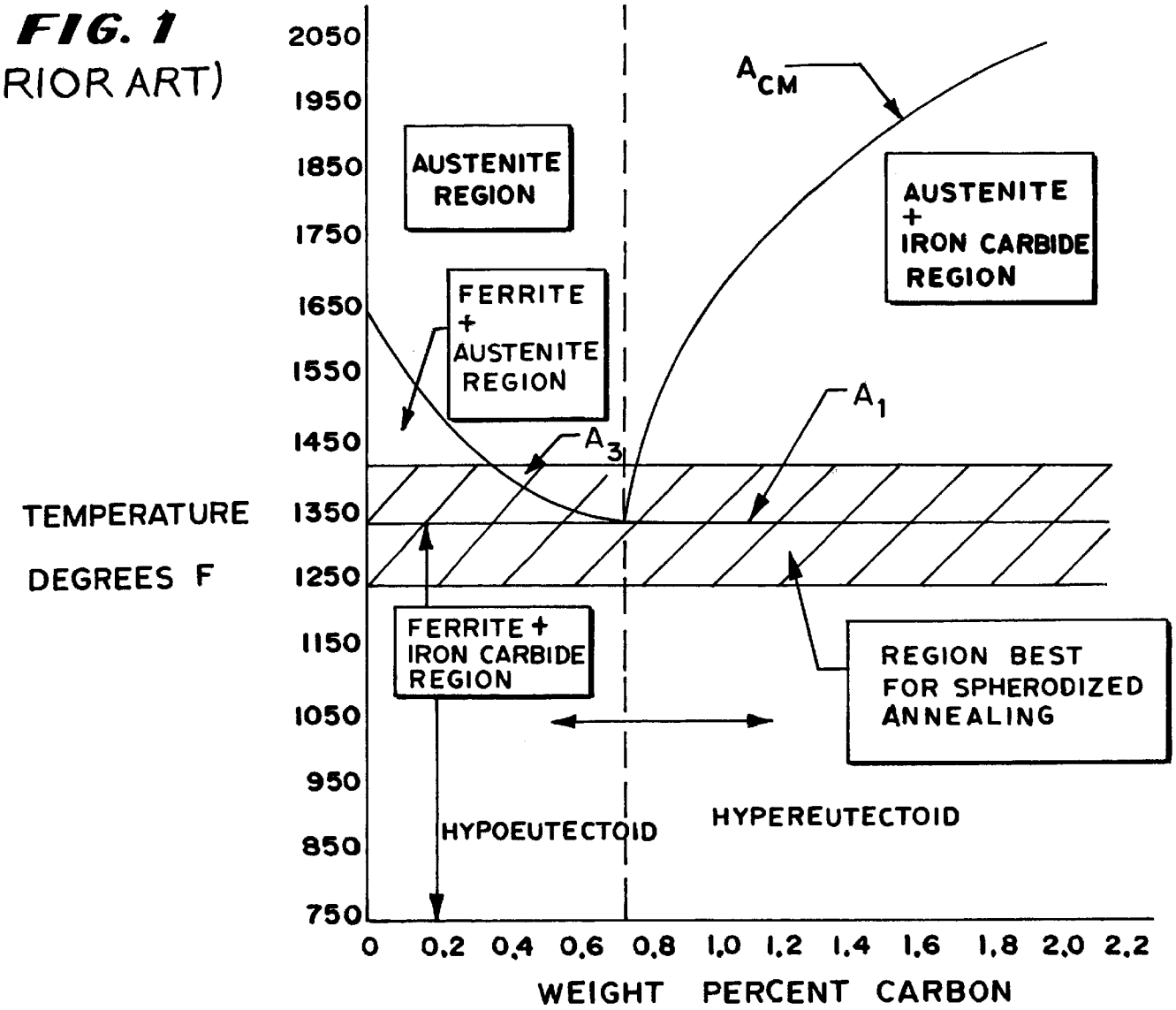
FIG. 1 (PRIOR ART)
FIG. 1 shows a typical prior art iron-carbon binary phase diagram for plain carbon steel compositions, identifying the temperature region conducive to spherodize annealing.
Figure 4:
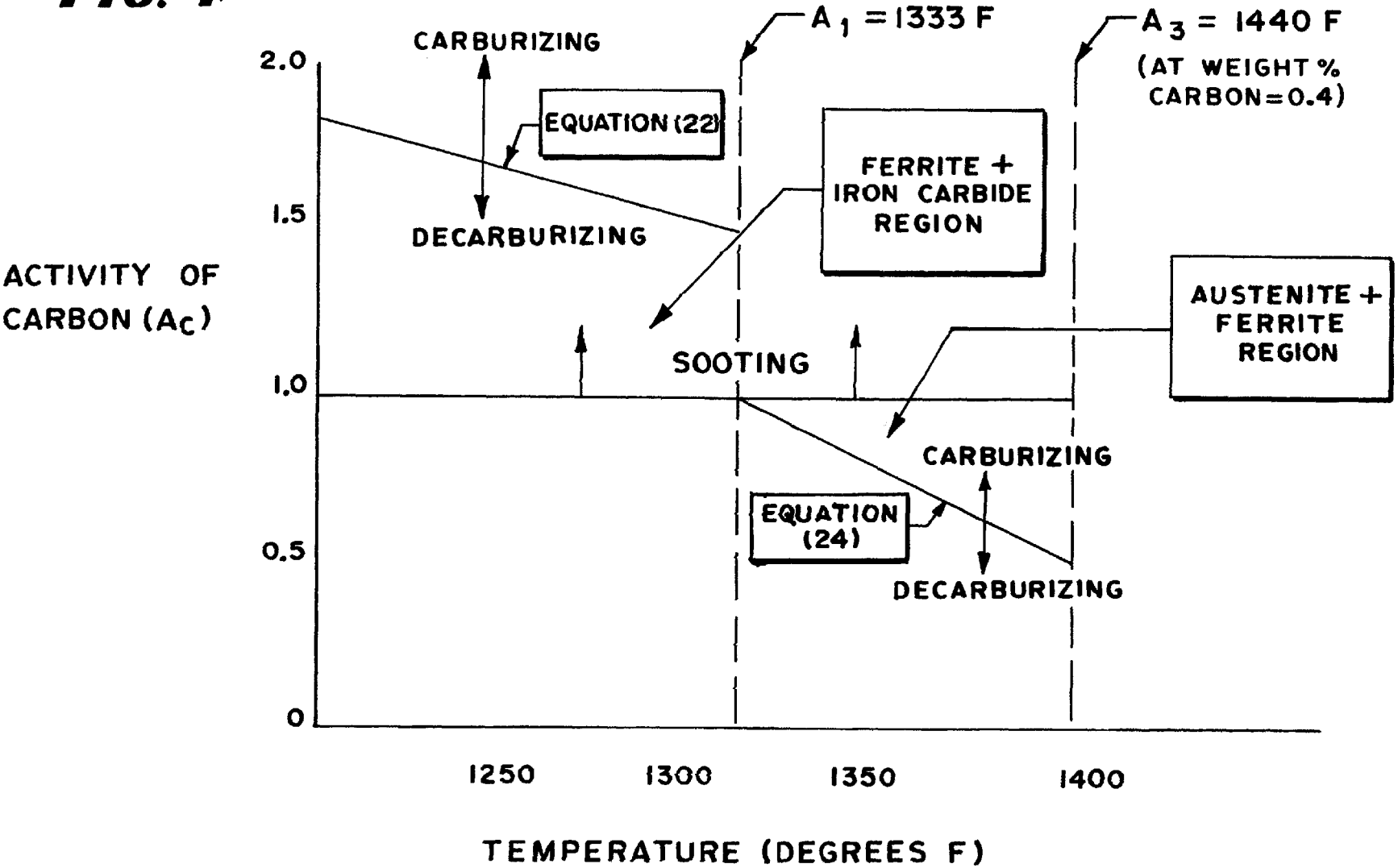
FIG. 4 is a representative plot showing the relationship between $A_C$ and temperature for a two phase condition of ferrite (α-Fe) and iron carbide ($Fe_3C$) or ferrite (α-Fe) and austenite (γ-Fe) for hypoeutectoid plain carbon steel.

FIG. 4 shows, based upon thermodynamic considerations, the relationship between $A_C$ and temperature for a two phase conditions of ferrite (α-Fe) and iron carbide ($Fe_3C$) or ferrite (α-Fe) and austenite (γ-Fe) in the region to the left of the dotted line in FIG. 1 (for hypoeutectoid plain carbon steel). The critical temperature $A_1$ is at or about 1333° F.

For temperatures below temperature $A_1$, the phases of ferrite (α-Fe)+iron carbide ($Fe_3C$) are the equilibrium phases. Above temperature $A_1$, the equilibrium phases of ferrite (α-Fe) and austenite (γ-Fe) exist, until temperature $A_3$. Above temperature $A_3$, the stable single phase austenite (γ-Fe) exists. This is also shown in FIG. 1. The value of $A_3$ is a function of weight percent carbon content, as FIG. 1 shows. In FIG. 4, $A_3$ is, for the purpose of illustration, expressed as 1440° F., which corresponds to a weight percent carbon value of 0.4% (see FIG. 1).

In the two phase region where ferrite (α-Fe) and iron carbide ($Fe_3C$) exists (i.e., below temperature $A_1$), the value of the activity of carbon $A_C$ at a given temperature is determined by the reaction and the standard free energy for the reaction, as follows:

$$Fe(\alpha)+C=Fe_3C;\Delta G_{19}^{\circ} \tag{19}$$

The equilibrium constant $K_{19}$ for the reaction in Equation (19) can be expressed as follows:

$$K_{19}=\frac{A_{Fe_3C}}{A_{Fe(\alpha)}A_C}=\exp^{-\Delta G_{19}^{O}/RT} \tag{20}$$

where:

$A_{Fe_3C}$ is the activity of iron carbide, $A_{F3(\alpha)}$ is the activity of ferrite.

The quantity:

$$\Delta G_{19}^{\circ}$$

is the standard free energy for Equation (19), expressed in calories per mole as follows:

$$\Delta G_{19}^{O}=3{,}850-11.41T+\ln T+9.66(10^{-3})T^2-\frac{0.4(10^5)}{T}+66.2T \tag{21}$$

R is the gas constant.

T is the temperature in ° K.

Since, at equilibrium, $A_{Fe3C}=1$ and $A_{Fe(\alpha)}=1$ then:

$$A_C=\exp^{\Delta G_{19}^{\circ}/RT} \tag{22}$$

Equation (22) expresses the equilibrium curve shown in FIG. 4 relating $A_C$ to temperature at temperatures below $A_1$. The equilibrium curve marks the transition between carburization and decarburization conditions. For a given temperature, carburization occurs for $A_C$ values above the intersection of the equilibrium curve and the temperature. Likewise, for a given temperature, decarburization occurs for $A_C$ values below the intersection of the equilibrium curve and the temperature.

The equation relating $A_C$ to temperature shown in FIG. 4 between the temperatures $A_1$ and $A_3$(where the two phases of ferrite (α-Fe)+austenite (γ-Fe) exist), is determined from the activity of austenite when in equilibrium with ferrite at temperature $A_3$. The carbon potential of the austenite at a given temperature can be ascertained using FIG. 1, from the intersection of the given temperature (on the Y-axis of FIG. 1) with the $A_3$ curve in FIG. 1. The carbon potential (on the x-axis of FIG. 1) which aligns with the temperature-$A_3$ intersection is the carbon potential for that temperature. For example, in FIG. 1, the intersection of the $A_3$ curve and the temperature 1400° F. on the Y-axis, aligns with a carbon potential of 0.5 on the x-axis.

The carbon potential (expressed as a weight % carbon) of the austentite for the temperature region $A_1$ to $A_3$, as determined above, can then be used to calculate the oxygen sensor output E(mv) from the following equation, which is based upon experimental data:

$$E(\text{mv})=A-B$$

where $$A=876.5+0.1601T-(55.75-0.1249T)\log C$$

$$B=(25.337+0.05512T)\log(CO/20) \tag{23}$$

where:

T is in ° F.

C is the wight percent carbon.

CO is the carbon monoxide content, expressed as a percentage.

The $A_C$ for the temperature region $A_1$ to $A_3$ can next be determined by applying Equation (7), using the value of E(mv) as calculated from Equation (23), and also using the same value of T. Any value of CO can be used as long as the same value is used in both Equation (7) and Equation (23). For each temperature, a similar process can be used to relate $A_C$ to temperature for the range $A_1$ to $A_3$, resulting in the plot shown in FIG. 4 for that temperature range.

In FIG. 4, the position of the temperature line marking $A_3$ is a function of the weight percent carbon in the steel undergoing annealing. The $A_3$=1440° F. line shown in FIG. 4 corresponds to a weight percent carbon value of 0.4. The position of the $A_3$ line will shift to the left for weight percent carbon values above 0.4, and will shift to the right for weight percent carbon values less than 0.4.

The slope of the equilibrium curve in the region $A_1$ to $A_3$ is not affected by the weight percent carbon value. The equilibrium curve for the region $A_1$ to $A_3$ can be approximated (by a best fit analysis) by the following equation:

$$A_C=8.975-0.005983T(^\circ\text{ F.}) \quad (24)$$

The intersection of the equilibrium curve of Equation (24) with the $A_3$ value for the relevant weight percent carbon value of the steel undergoing annealing marks the lowest activity of carbon value at the transition from the two phase austenite-ferrite region to a single phase austenite region.

In the temperature range between $A_1$ and $A_3$, the equilibrium curve marks the transition between carburization and decarburization. For a given temperature, carburization occurs for $A_C$ values above the intersection of the equilibrium curve and the temperature. Likewise, for a given temperature, decarburization occurs for $A_C$ values below the intersection of the equilibrium curve and the temperature.

FIG. 4, as generated above, shows that, for temperatures below $A_1$, the preferred set point is $A_C \approx 1$, as sooting occurs as $A_C>1$. The rate of sooting is a function of the CO content in the atmosphere. FIG. 4 also shows that the entire equilibrium curve for ferrite and iron carbide curve exists in the region where $A_C>1$. FIG. 4 shows that, for temperatures below $A_1$, a decarburizing condition should be tolerated, to reduce the incidence of sooting.

For temperature conditions between $A_1$ and $A_3$, FIG. 4 shows that the entire equilibrium curve for austenite and ferrite exists in the region where $A_C<1$. FIG. 4 shows that, for temperatures between $A_1$ and $A_3$, $A_C$ can be maintained below 1.0 to maintain equilibrium while preventing the incidence of sooting.

For alloy steels, the magnitudes of the temperatures $A_1$ and $A_3$ depend both on the alloy elements present and the concentration of the alloy elements. Furthermore, the magnitude of the activity of carbon $A_C$ is also affected by the type and concentration of alloy elements.

The control function 46 generates command signals based upon the comparison of the computed value $A_C$ to the set point value. The control function 46 adjusts the mixture of gases provided by the source 14 to the furnace 12, to establish and maintain the computed value $A_C \approx 1$ at temperatures below $A_1$ and to maintain the computed value $A_C$ at the value derived from Equation (24) at temperatures between $A_1$ and $A_3$.

It can therefore be seen from FIG. 4 that, for hypoeutectoid plain carbon steel, the set point $A_C$ is a function of temperature T. The set point $A_C$ can be assigned a generally fixed value (i.e., ≈1.0) at temperatures below $A_1$ (1333° F.). At temperatures between $A_1$ and $A_3$, the set point $A_C$ is assigned a value determined from Equation (24).

In this way, the control function 46 works to maintain prescribed atmosphere conditions within the furnace 12 optimal for spherodize annealing in both two phase regions ferrite plus iron carbide (below temperature $A_1$) and ferrite plus austenite (between temperatures $A_1$ and $A_3$). By maintaining the computed value $A_C$ at the set point value, the control function 46 prevents both carburization and sooting, while minimizing decarburization in the two phase regions.

The same control function 46 can also serve to prevent oxidation and minimize internal oxidation. The magnitude of E(mv) at a given temperature condition is indicative of the partial pressure of oxygen $P_{O2}$ in the gas atmosphere inside the furnace 12. In the illustrated and preferred embodiment, the control function 46 compares E(mv) generated by the in situ oxygen sensor 22 to a threshold value, which is selected based upon experimental data to mark an oxygen condition close to the onset of oxidation at the temperature condition sensed by the in situ temperature sensor 20. The operator can supply the selected threshold value, e.g., using an input 66.

Figure 5:
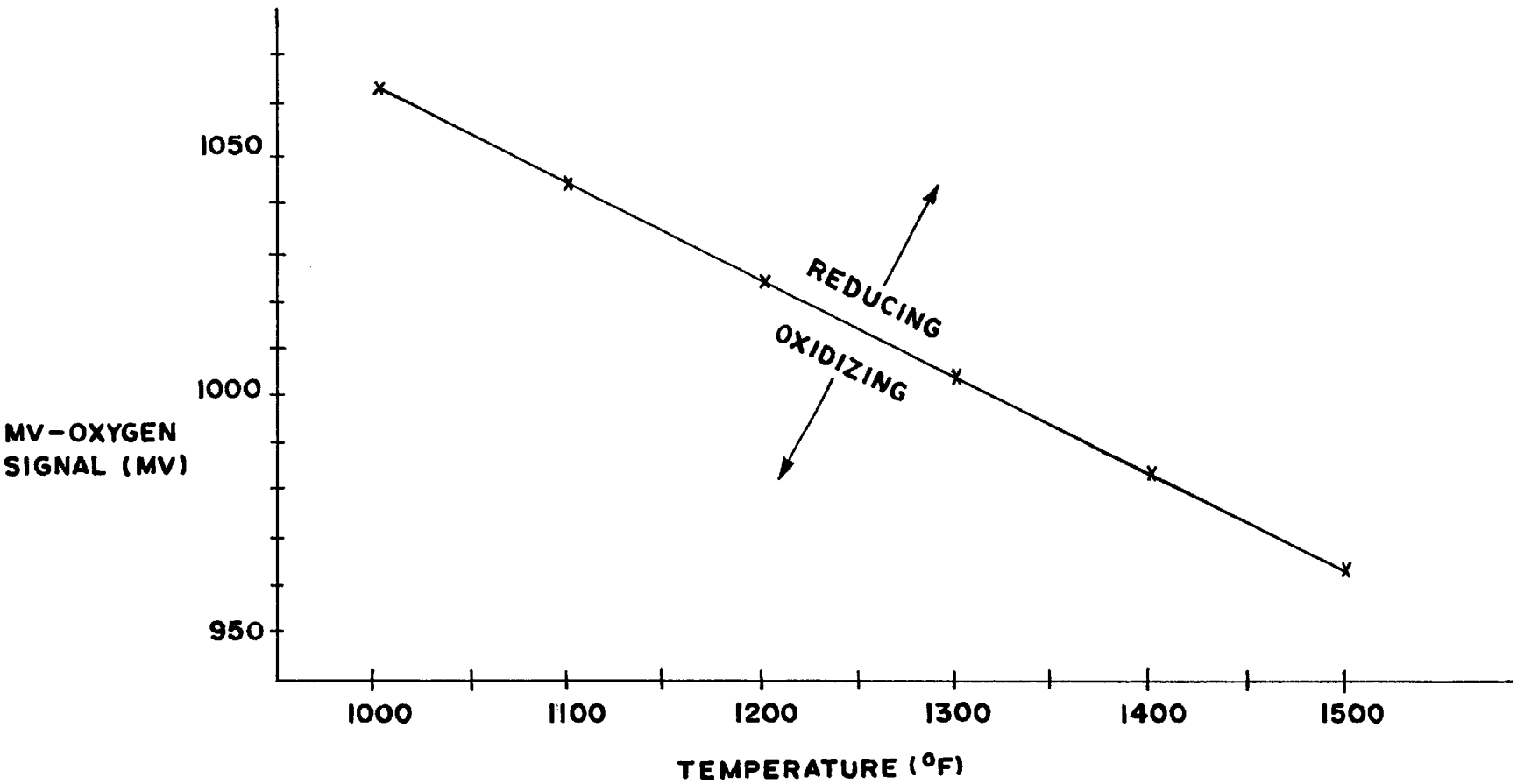
FIG. 5 is a representative plot showing the relationship of the onset of oxidation to the outputs of an oxygen sensor over a range of temperatures.

The relationship between E(mv) and the onset of oxidation of iron over a given range of temperatures can be experimentally determined. FIG. 5 illustrates a representative plot of the relationship based upon actual data and observation. FIG. 5 plots the E(mv) output (y-axis) over a given temperature range (° F.) (x-axis). The intersection of a given temperature (on the x-axis) and the line shown in FIG. 5 identifies an E(mv) value that marks the threshold of the onset of oxidation. Signal values less than the threshold indicate the likelihood of oxidation.

For example, based upon FIG. 5, if the gas atmosphere temperature is 1200° F., the threshold E(mv)signal value is about 1023 mv. If the E(mv) signal at that temperature is less than this threshold value, the control function 46 generates an oxidation alert alarm. The operator is thereby prompted to check for air leaks in the furnace 12 and take other corrective action to prevent oxidation.

Based on Equation (7), for a fixed value of $A_C$ (e.g., $A_C$=1) and a constant temperature condition (which is usually the objective of the temperature controller 26), E(mv) decreases with increasing concentrations of carbon monoxide. Thus, at lower temperature conditions, it is possible to have an atmosphere that is both carburizing and oxidizing. Therefore, the oxidation alert features just described is very useful when using atmospheres with higher carbon monoxide concentrations.

III. Graphical User Interfaces

In the illustrated embodiment (see FIG. 6), the display device 48 provides an interactive user interface 136. The interface 136 allows the operator to select, view and comprehend information regarding the operating conditions within the spherodize annealing zone. The interface 136 also allows the operator to change metal heat treating conditions in the zone.

The interface 136 includes an interface screen 138. It can also include an audio or visual device to prompt or otherwise alert the operator when a certain processing condition or conditions arise. The interface screen 138 displays information for viewing by the operator in alpha-numeric format and as graphical images. The audio device (if present) provides audible prompts either to gain the operator's attention or to acknowledge operator actions.

Figure 6:
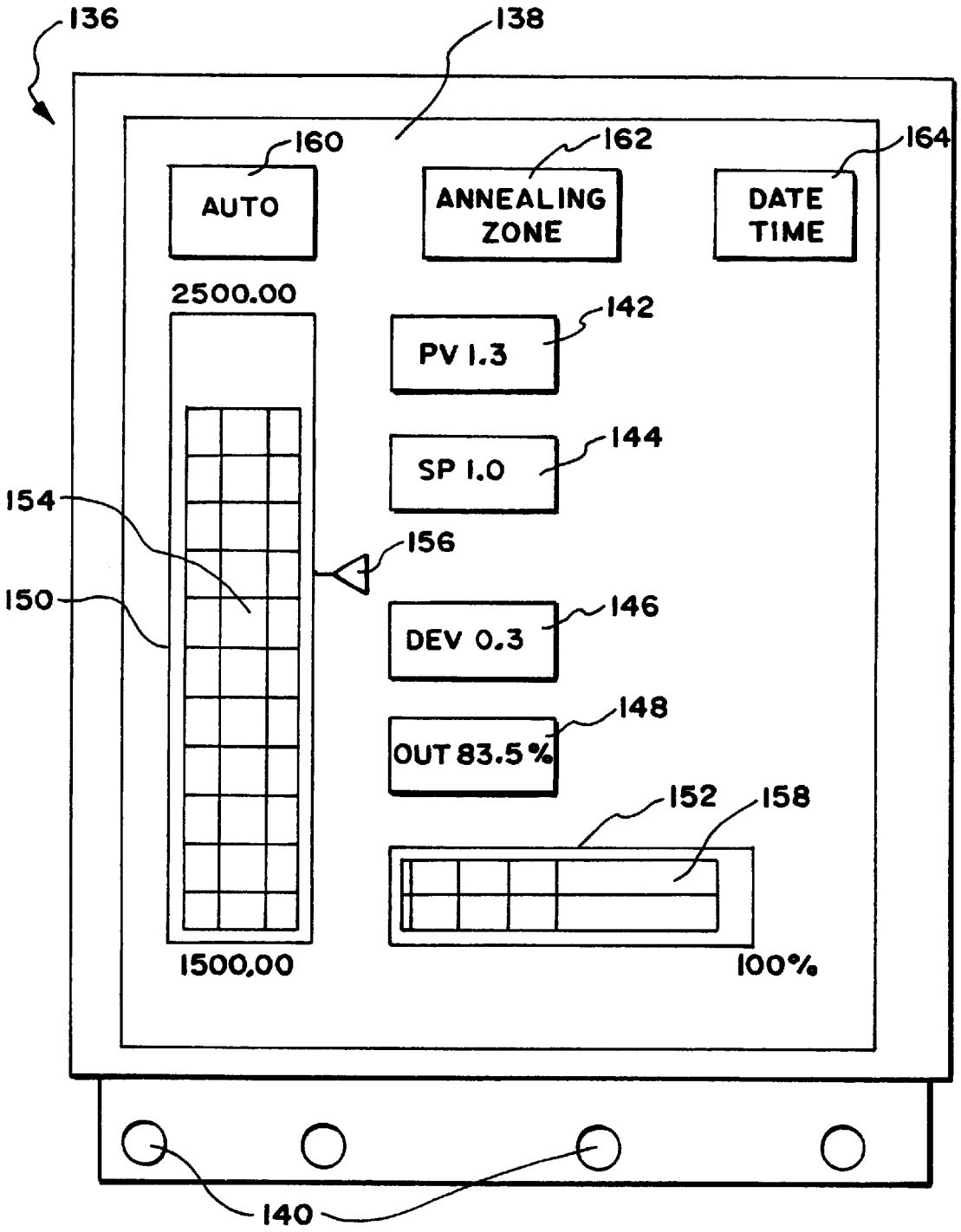
FIG. 6 is a representative screen of a graphical user interface to display information processed by the processing function for the furnace shown in FIG. 2.

The interface screen 138 can also serve as an input device, to input from the operator by conventional touch activation. Alternatively or in combination with touch activation, a mouse or keyboard or dedicated control buttons could be used as input devices. FIG. 6 shows various dedicated control buttons 140.

The format of the interface screen 138 and the type of alpha-numeric and graphical images displayed can vary.

A representative user interface screen 138 is shown in FIG. 6. The screen 138 includes four block fields 142, 144, 146, and 148, which contain information, formatted in alpha-numeric format. The information is based upon data received from the associated heat and atmosphere controllers, relating to processing conditions within the spherodize annealing furnace 12.

The first field 142 displays in alphanumeric format a process variable (PV), which is indicative of the activity of carbon valve $A_C$ derived by sensing from the in situ sensors residing the annealing atmosphere of the furnace 12. The value displayed in the first field 142 comprises the quantity $A_C$ derived by the algorithm 44 according to Equation (7).

The second field 144 displays in alphanumeric format the set point value SP for the activity of carbon $A_C$ for the given processing condition. The value displayed is received as input from the operator, as previously explained.

The third field 146 displays in alphanumeric format the deviation DEV derived by the comparator function 52 of the atmosphere control function 52. The deviation DEV displays the difference between the process variable PV and the set point SP.

The fourth field 148 displays in alphanumeric format the percent output (OUT), which reflects the magnitude of the control correction commanded to bring the process variable PV to the set point SP.

The screen 138 also includes two graphical block fields 150 and 152. The fields 150 and 152 provide information about the processing conditions within a given zone of the furnace 56 in a graphical format.

The first block field 150 includes a vertically oriented, scaled bar graph. A colored bar 154 graphically shows the magnitude of the process variable PV relative to the set point on the bar graph. An icon 156 marks the set point value within the scale of the bar graph.

The second block field 152 includes a horizontally oriented, bar graph scaled between 0 and 100. A colored bar 158 graphically depicts percent output (OUT), which is the magnitude of the control correction commanded to bring the process variable PV to the set point SP, as before explained.

As FIG. 6 shows, the screen 138 also includes various other an alpha-numeric block fields 160, 162, and 164 displaying status information. The block field 160 identifies the mode of atmosphere control, e.g., AUTO (for automatic control by the processing module) or MAN (for manual). The block field 162 identifies that the annealing zone of the furnace 12 is being monitored. The block field 164 contains date and time stamp.

By selection of a control button 140, the operator can select among different display options for viewing information relating to the selected zone. For example, the operator can select a trend display (see FIG. 7), which graphically displays the variation over time of selected processing conditions, e.g., PV, E(mv), % CO, and T. As another example, the operator can select a real time data display (see FIG. 8), which records instantaneous unit data values for selected processing variables, e.g., measured temperature T, the oxygen sensor output E(mv), the % CO, and the computed $A_C$ value, and the process set point for $A_C$.

Figure 7:
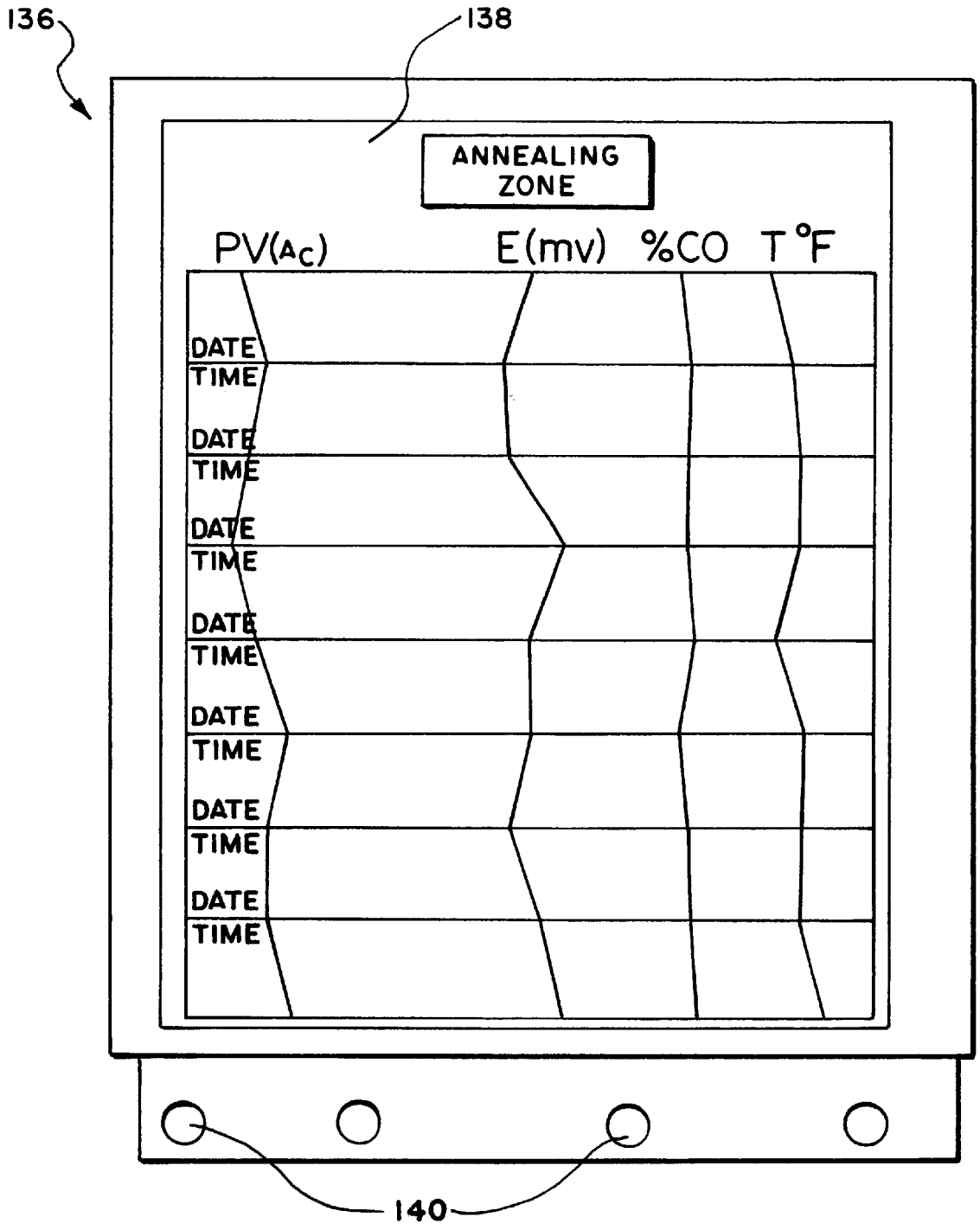
FIG. 7 is a screen of the data shown in FIG. 6, with the data recorded in a trend format.
Figure 8:
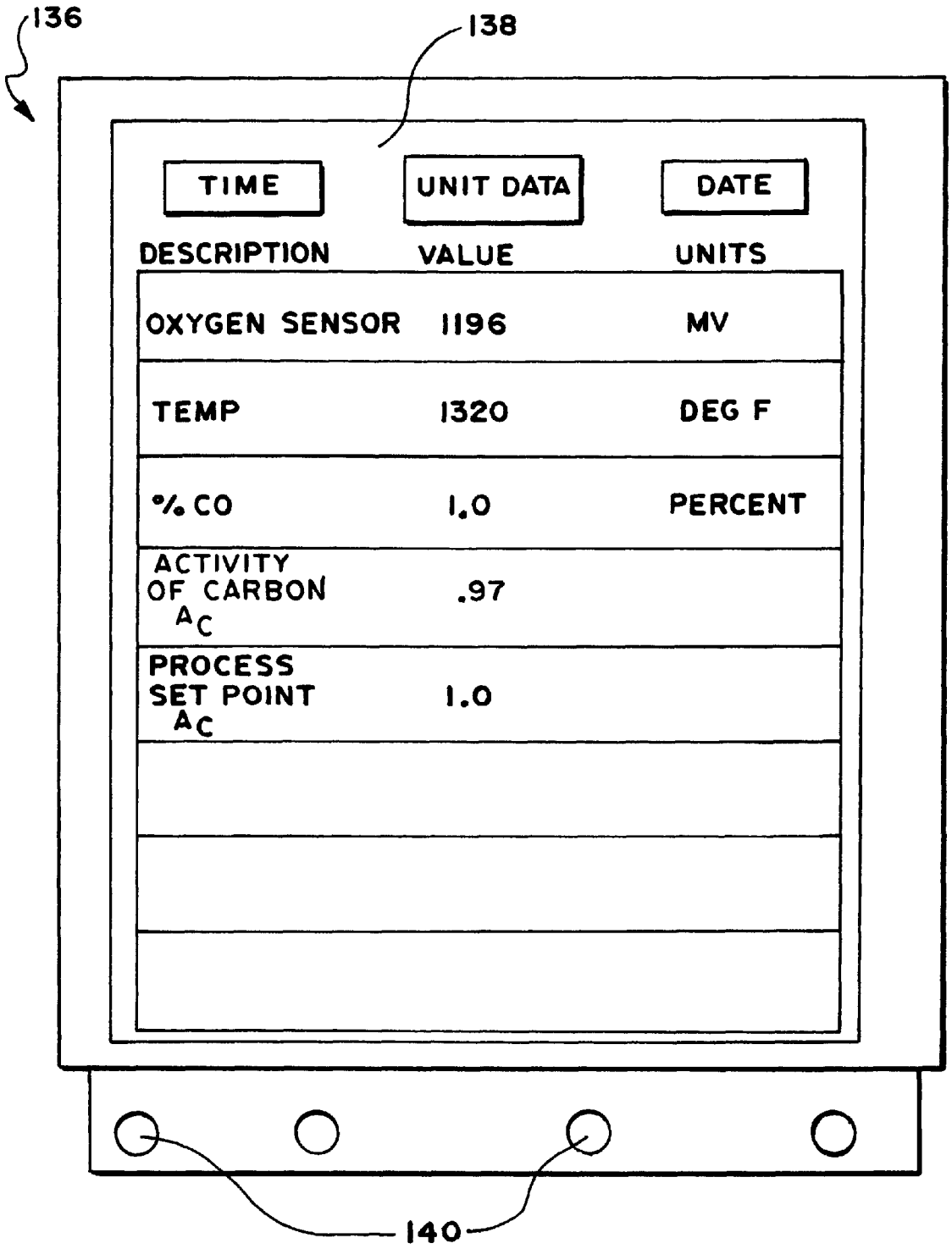
FIG. 8 is the screen of the data shown in FIG. 6, with the data displayed in a unit data format.

The graphical user interface 136 shown in FIGS. 6 to 8 can be realized using a HONEYWELL™ VPR-100 Controller with standard or advanced free form math capability (Honeywell, Inc.).

The features of the invention are set forth in the following claims.

We claim:

1. A heat treating system for a steel part comprising a heat treating furnace sized and configured to receive the steel part, means communicating with the heat treating furnace for supplying to the heat treating furnace a gas atmosphere for reaction with the steel part, means communicating with the heat treating furnace for generating a temperature condition within the heat treating furnace that produces a two-phase field comprising relative amounts of ferrite and iron carbide in the steel part during the reaction, a processor including a processing function to generate a computed activity of carbon value for the gas atmosphere as a function of temperature, partial pressure of oxygen, and carbon monoxide content of the gas atmosphere, and without reliance upon a carbon dioxide content of the gas atmosphere, the processor including an atmosphere control function comprising a comparator to compare the computed activity of carbon value to a set point selected to maintain the relative amounts of ferrite and iron carbide of the two-phase field in a desired state during the reaction and to generate a deviation, and an output terminal coupled to the processor to output at least one of the computed activity of carbon value and the deviation.

2. The system according to claim 1 wherein the output terminal is coupled to a controller for the gas atmosphere.

3. The system according to claim 2 and further including an input for recording the set point from an operator.

4. The system according to claim 1 wherein the output terminal is coupled to a device for displaying the computed activity of carbon value.

5. The system according to claim 1 wherein the output terminal is coupled to a device for recording the computed activity of carbon value.

6. The system according to claim 1 and further including an input adapted to receive an electrical signal generated by at least one sensor indicating either the partial pressure of oxygen or the temperature of the gas atmosphere, and wherein the processor processes the electrical signal to generate the computed activity of carbon value.

7. The system according to claim 1 and further including an input adapted to be coupled to a temperature sensor that generates an electrical signal that varies according to the temperature of the gas atmosphere, and wherein the processor processes the electrical signal to generate the computed activity of carbon value.

8. The system according to claim 1 and further including an input adapted to be coupled to an oxygen sensor that generates an electrical signal that varies according to the temperature and partial pressure of oxygen of the gas atmosphere, and wherein the processor processes the electrical signal to generate the computed activity of carbon value.

9. The system according to claim 1 wherein the processor also generates an oxidation alarm based upon the partial pressure of oxygen and temperature of the gas atmosphere.

10. The system according to claim 1 and further including an input coupled to the processor and adapted to receive an electrical signal that varies according to the carbon monoxide content of the gas atmosphere, and wherein the processor processes the electrical signal to generate the computed activity of carbon valued.

11. The system according to claim 10 wherein the electrical signal is generated based upon analysis of a sample of the gas atmosphere.

12. The system according to claim 10 wherein the electrical signal is set based upon a known carbon monoxide content of the gas atmosphere.

13. A heat treating system for a steel part comprising a heat treating furnace sized arid configured to receive the steel part, means communicating with the heat treating furnace for supplying to the heat treating furnace a gas atmosphere for reaction with the steel part, means communicating with the heat treating furnace for generating a temperature condition within the heat treating furnace that produces a two-phase field comprising relative amounts of ferrite and iron carbide in the steel part during the reaction, at least one sensor placed in situ in the gas atmosphere, a processing element including a processing function to derive a process variable indicative of an activity of carbon value for the gas atmosphere derived from the at least one sensor as a function of temperature, partial pressure of oxygen, and carbon monoxide content of the gas atmosphere, and without reliance upon a carbon dioxide content of the gas atmosphere, the processing element including an atmosphere control function comprising a comparator to compare the process variable to a set point selected to maintain the relative amounts of ferrite and iron carbide of the two-phase field in a desired state during the reaction and to generate a deviation, and an output coupled to the processing element to output at least one of the process variable and the deviation.

14. The system according to claim 13 wherein the output is coupled to a device that displays the process variable.

15. The system according to claim 13 wherein the output is coupled to a device that records the process variable.

16. The system according to claim 13 wherein the output is coupled to a device that generates the gas atmosphere based, at least in part, upon the deviation.

17. A spherodize annealing system for a steel part comprising a heat treating furnace sized and configured to receive the steel part, means communicating with the heat treating furnace for supplying to the heat treating furnace a preselected gas atmosphere for reaction with the steel part, means communicating with the heat treating furnace for generating a temperature condition within the heat treating furnace that produces a two-phase field comprising relative amounts of ferrite and iron carbide in the steel part during the reaction, an oxygen sensor located in situ in the heat treating furnace in contact with the preselected gas atmosphere, the oxygen sensor providing a first electrical input that varies according to oxygen content of the preselected gas atmosphere, a temperature sensor located in situ in the heat treating furnace in contact with the preselected gas atmosphere, the temperature sensor providing a second electrical input that varies according to temperature of the preselected gas atmosphere, and a processor including a processing function to generate a computed activity of carbon value for the preselected gas atmosphere as a function of the first and second electrical inputs and without reliance upon a carbon dioxide content of the gas atmosphere, the processor including an atmosphere control function comprising a comparator to compare the computed activity of carbon value to a set point selected to maintain the relative amounts of ferrite aid iron carbide of the two-phase field in a desired state during the reaction and to generate a deviation, and an output terminal coupled to the processor to output at least one of the computed activity of carbon value and the deviation.

18. The system according to claim 17 wherein the output terminal is coupled to a device for displaying the computed activity of carbon value.

19. The system according to claim 17 wherein the output terminal is coupled to a device for recording the computed activity of carbon value.

20. The system according to claim 17 wherein the output terminal is coupled to a controller for the atmosphere source.

21. A spherodize annealing system for a steel part comprising a heat treating furnace sized and configured to receive the steel part, means communicating with the heat treating furnace for supplying to the heat treating furnace a preselected gas atmosphere for reaction with the steel part, means communicating with the heat treating furnace for generating a temperature condition within the heat treating furnace that produces a two-phase field comprising relative amounts of ferrite and iron carbide in the steel part during the reaction, a processor including a processing function to generate a computed activity of carbon value for the preselected gas atmosphere as a function of temperature, partial pressure of oxygen, and carbon monoxide content of the preselected gas atmosphere, and without reliance upon a carbon dioxide content of the preselected gas atmosphere, the processor including an atmosphere control function comprising a comparator to compare the computed activity of carbon value to a set point selected to maintain the relative amounts of ferrite and iron carbide of the two-phase field in a desired state during the reaction and to generate a deviation, an output terminal coupled to the processor to output the deviation, and a controller coupled to the output terminal and the atmosphere source to control generation of the preselected gas atmosphere according to the deviation.

22. The system according to claim 21 wherein the set point value varies as a function of temperature.

23. A method for heat treating a steel part comprising the steps of exposing the steel part to a heat treating atmosphere for reaction with the steel part at a temperature condition that produces a two-phase field comprising relative amounts of ferrite and iron carbide in the steel part during the reaction, generating a computed activity of carbon value of the heat treating atmosphere as a function of temperature, partial pressure of oxygen, and carbon monoxide content of the heat treating atmosphere, and without reliance upon a carbon dioxide content of the heat treating atmosphere, comparing the computed activity of carbon value to a set point selected to maintain the relative amounts of ferrite and iron carbide of the two-phase field in a desired state during the reaction and generating a deviation, and using at least one of the computed activity of carbon value and the deviation to monitor the heat treating atmosphere.

24. The method according to claim 23 wherein the using step includes controlling the heat treating atmosphere based, at least in part, upon the deviation.

25. The method according to claim 24 wherein the using step includes recording the computed activity of carbon value.

26. The method according to claim 24 wherein the using step includes displaying the computed activity of carbon value.

27. A method for heat treating a steel part comprising the steps of exposing the steel part to a heat treating atmosphere for reaction with the steel part at a temperature condition that produces a two-phase field comprising relative amounts of ferrite and iron carbide in the steel part during the reaction, deriving from at least one sensor placed in situ in the heat treating atmosphere a process variable indicative of the activity of carbon in the heat treating atmosphere as a function of temperature, partial pressure of oxygen, and carbon monoxide content of the gas atmosphere, and without reliance upon a carbon dioxide content of the gas atmosphere, the processing element including an atmosphere control function comprising a comparator to compare the process variable to a set point selected to maintain the relative amounts of ferrite and iron carbide of the two-phase field in a desired state during the reaction and to generate a deviation, and using at least one of the process variable and the deviation to monitor the heat treating atmosphere.

28. The method according to claim 27 wherein the using step includes controlling the heat treating atmosphere based, at least in part, upon the deviation.

29. The method according to claim 27 wherein the using step includes recording the process variable.

30. The method according to claim 27 wherein the using step includes displaying the process variable.

31. A method for performing spherodize annealing of a steel part comprising the steps of generating a gas atmosphere and supplying the gas atmosphere to a furnace for reaction with the steel part, heating the gas atmosphere in the furnace sufficiently to create a two phase region comprising relative amounts of ferrite and iron carbide in the steel part during the reaction, generating a computed activity of carbon value for the gas atmosphere as a function of temperature, partial pressure of oxygen, and carbon monoxide content of the gas atmosphere, and without reliance upon a carbon dioxide content of the gas atmosphere, the processing element including an atmosphere control function comprising a comparator to compare the process variable to a set point selected to maintain the relative amounts of ferrite and iron carbide of the two-phase field in a desired state during the reaction and to generate a deviation, and controlling the gas atmosphere according to the deviation.

32. The method according to claim 31 wherein the selected set point varies as a function of temperature.

33. A method for performing spherodize annealing of a steel part comprising the steps of generating a gas atmosphere and supplying the gas atmosphere to a furnace for reaction with the steel part, heating the gas atmosphere in the furnace sufficiently to create a two phase region comprising relative amounts of ferrite and iron carbide in the steel part during the reaction, sensing oxygen content with an oxygen sensor placed in situ in the furnace to provide a first electrical output that varies according to oxygen content of the gas atmosphere, sensing temperature with a temperature sensor placed in situ in the furnace to provide a second electrical output that varies with temperature, computing an activity of carbon value based upon the first and second electrical outputs and without reliance upon a carbon dioxide content of the gas atmosphere, comparing the computed activity of carbon value to a set point selected to maintain the relative amounts of ferrite and iron carbide of the two-phase field in a desired state during the reaction, generating a deviation between the computed activity of carbon value and the set point, and by controlling the gas atmosphere according to the deviation.

34. The method according to claim 33 wherein the selected set point varies as a function of temperature.

* * * * *